US005980356A

United States Patent [19]

Meng-Suen

[11] Patent Number: 5,980,356

[45] Date of Patent: Nov. 9, 1999

[54] MAGNETIC DRIVE SYSTEM FOR A MOVING DISPLAY

[75] Inventor: Huang Meng-Suen, Kowloon, The Hong Kong Special Administrative Region of the People's Republic of China

[73] Assignee: Mr. Christmas, Inc., New York, N.Y.

[21] Appl. No.: 08/947,325

[22] Filed: Oct. 8, 1997

[51] Int. Cl.[6] ..... A63H 11/00; A63H 33/26

[52] U.S. Cl. ..... 446/332; 446/136

[58] Field of Search ..... 446/332, 330, 446/352, 357, 139, 137, 135, 134, 133, 358, 136

[56] References Cited

U.S. PATENT DOCUMENTS

| | | | |
|---|---|---|---|
| 532,678 | 1/1895 | Martin . | |
| 1,608,353 | 11/1926 | Zaikine . | |
| 1,740,172 | 12/1929 | Hagemo | 446/357 |
| 2,192,476 | 5/1940 | Marvin . | |
| 2,396,382 | 3/1946 | Maibaum . | |
| 2,471,002 | 5/1949 | Mohr . | |
| 2,645,880 | 7/1953 | Richter . | |
| 2,874,513 | 2/1959 | Connell | 446/332 |
| 2,933,854 | 4/1960 | Crosman | 446/358 |
| 2,979,861 | 4/1961 | Staaf . | |
| 3,432,961 | 3/1969 | Goldfarb . | |
| 3,510,949 | 5/1970 | Christy . | |
| 4,177,592 | 12/1979 | Ruck . | |
| 4,183,172 | 1/1980 | Lewis et al. | 446/332 |
| 4,237,648 | 12/1980 | Moe et al. | 446/332 |
| 4,838,825 | 6/1989 | Hwang et al. . | |
| 5,462,472 | 10/1995 | Lin . | |

FOREIGN PATENT DOCUMENTS

| | | | |
|---|---|---|---|
| 1253078 | 12/1960 | France | 446/332 |
| 352221 | 3/1961 | Switzerland | 446/303 |
| 674801 | 7/1952 | United Kingdom | 446/436 |

*Primary Examiner*—D Neal Mair
*Attorney, Agent, or Firm*—Fitzpatrick, Cella, Harper & Scinto

[57] ABSTRACT

A magnetic driving mechanism for a moving display includes a guide track secured to a base of the display, a magnet driver arm rotatably supported on the base, and a driving assembly for rotating the driver. A magnet support is mounted in a slot of the driver and capable of radial and rotational movement as it travels in the guide track. A turning mechanism allows the magnet support to turn as it travels in the guide track.

26 Claims, 5 Drawing Sheets

MAGNETIC DRIVE SYSTEM FOR A MOVING DISPLAY

BACKGROUND OF THE INVENTION

1. Field of the Invention

The present invention relates generally to an animated display device having figurines that are moved over a display surface by magnetic forces. More particularly, the present invention relates to a drive system for driving magnets that move the figurines in the animated display device.

2. Description of the Prior Art

Using the magnetic force of magnets to move figurines over a display surface has been done for many years. Typically, a display surface of a toy will be formed to represent some type of recreational area or scene such as, for example, a skating rink, a race track, etc., and one or more magnets will be supported for movement just beneath the display surface. As the magnetic force attracts the figurine, movement of the magnet maneuvers the figurine, such as an ice skater or a race car, over the display surface. Along with many different kinds of display surfaces, many types of drive systems for moving the magnets below the display surface have been proposed through the years.

One type of recreational area that has proven to be popular is a skating rink. For example, U.S. Pat. No. 4,838,825 (Hwang et al.) discloses a toy kiddieland wherein the display surface includes a skating rink, an undulating track and a play area that includes swings, all of which have figurines that are moved by the magnetic force of magnets. Beneath the display surface is a plate rotatably mounted on a base and equipped with a plurality of magnets. Magnets positioned beneath the skating rink are mounted in pairs on either end of a rotary shaft. The pairs of magnets revolve with the rotating plate and can also rotate about their respective shafts through attraction to a stationary magnet secured to the base of the display. Additional magnets are mounted on vertically movable shafts for moving figurines, such as cars, over the track, and magnets secured to the outer periphery of the plate move the swinging displays.

U.S. Pat. No. 2,645,880 (Richter) discloses another type of animated skating rink. In this patent, magnets are moved below the skating surface by an endless belt. A drive gear and a plurality of idler gears are provided to support and drive the belt in a tortuous path. Additional magnets are supported and driven in independent paths by a supplemental drive system, which also uses an endless belt.

A different type of toy is disclosed in U.S. Pat. No. 3,510,949 (Christy), wherein a figurine is moved over a flat surface in a geometric pattern. The figurine is equipped to hold a writing instrument for tracing its geometric path on a piece of paper placed on the flat surface. The drive mechanism in this patent utilizes a plurality of planetary gears rotatably mounted on a gear base and keyed to a stationary sun gear. A quadripole magnet is eccentrically mounted to each planetary gear. As the base rotates, the planetary gears revolve around the sun gear and rotate about their own axis to effect movement of the magnets.

Great Britain patent no. 674,801 relates to a magnetically operated toy, e.g., a car, that can be "driven" over a display surface by operating a steering wheel. To move the car, a magnet beneath the display surface is supported in a carriage and mounted for radial and rotational movement in an arm of the driving mechanism. The carriage is mounted in a longitudinal slot of the arm. As the arm rotates the carriage can move longitudinally within the slot by a rope drive assembly using a rope and a series of pulleys. Turning the steering wheel operates the rope to radially maneuver the car as it moves in the rotating arm.

However, the magnetic drive systems discussed above, and those generally known, have certain limitations in the manner and patterns in which the magnets are driven. Thus, an improved magnetic drive system is desirable for providing better and more creative movement of figurines over a display surface.

SUMMARY OF THE INVENTION

It is a general object of the present invention to provide an animated display with improved movement of figurines over a display surface.

It is therefore an object of the present invention to provide an improved drive mechanism for driving magnets below a surface of an animated display device.

It is another object of the invention to drive the magnet in a primary path about a central axis of the drive mechanism and in a secondary path.

It is yet another object of the invention to provide a drive mechanism that can drive the magnets in the primary path along a non-circular path.

It is still another object of the invention to provide a drive mechanism that can drive the magnets in the secondary path to turn in one direction and then turn back in an opposite direction.

In accordance with one aspect of the invention, a driving mechanism for moving a figurine over a display surface comprises a base, a guide track secured to the base, and a magnet driver rotatably mounted to the base. In addition, a driving assembly rotates the magnet driver, and a magnet holder is secured in the magnet driver and rides in the guide track.

The guide track includes a path with a first portion having a first width and a second portion having a second width wider than the first width. In addition, turning means is provided for turning the magnet holder, with the magnet holder positioned in one orientation in the first portion of the path and in a second orientation in the second portion of the path.

The magnet driver defines a radial slot in which the magnet holder is supported, with the magnet holder capable of sliding radially within the slot to follow the guide track.

In accordance with another aspect of the invention, a driving mechanism for moving a figurine over a display surface comprises a base, a guide track secured to the base, a magnet holder riding in the guide track, and a drive assembly for driving the magnet holder in the guide track and about a rotational axis. The drive assembly includes a rotating driver securing the magnet holder and allowing for radial movement of the magnet holder as it moves about the rotational axis.

In accordance with still another aspect of the invention, a display device comprises a base, a guide track disposed on the base, and a magnet driver rotatably supported on the base. Also provided is drive means for rotating the magnet driver about a first rotational axis, a magnet holder supported in the magnet driver for movement in the guide track, a magnet supported in the magnet driver, and a display surface over which a figurine moves. Turning means turns the driver about its own axis as it travels in the guide track.

Accordingly, the present invention provides a magnetic drive system that can move the figurines in primary and secondary paths along the display surface.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
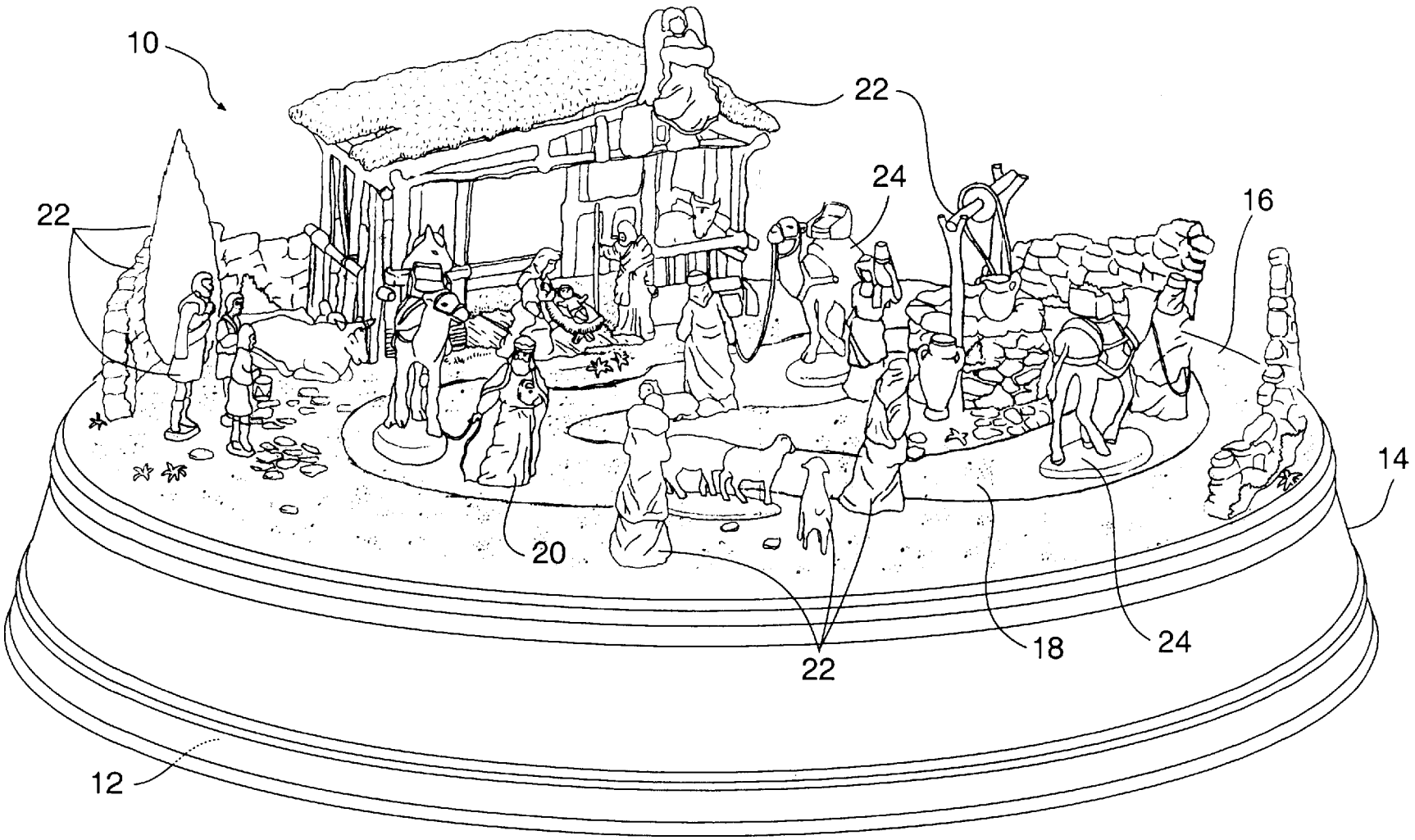
FIG. 1 is a perspective view of an animated display device and figurines in accordance with the present invention, showing a platform of the display device.
Figure 2:
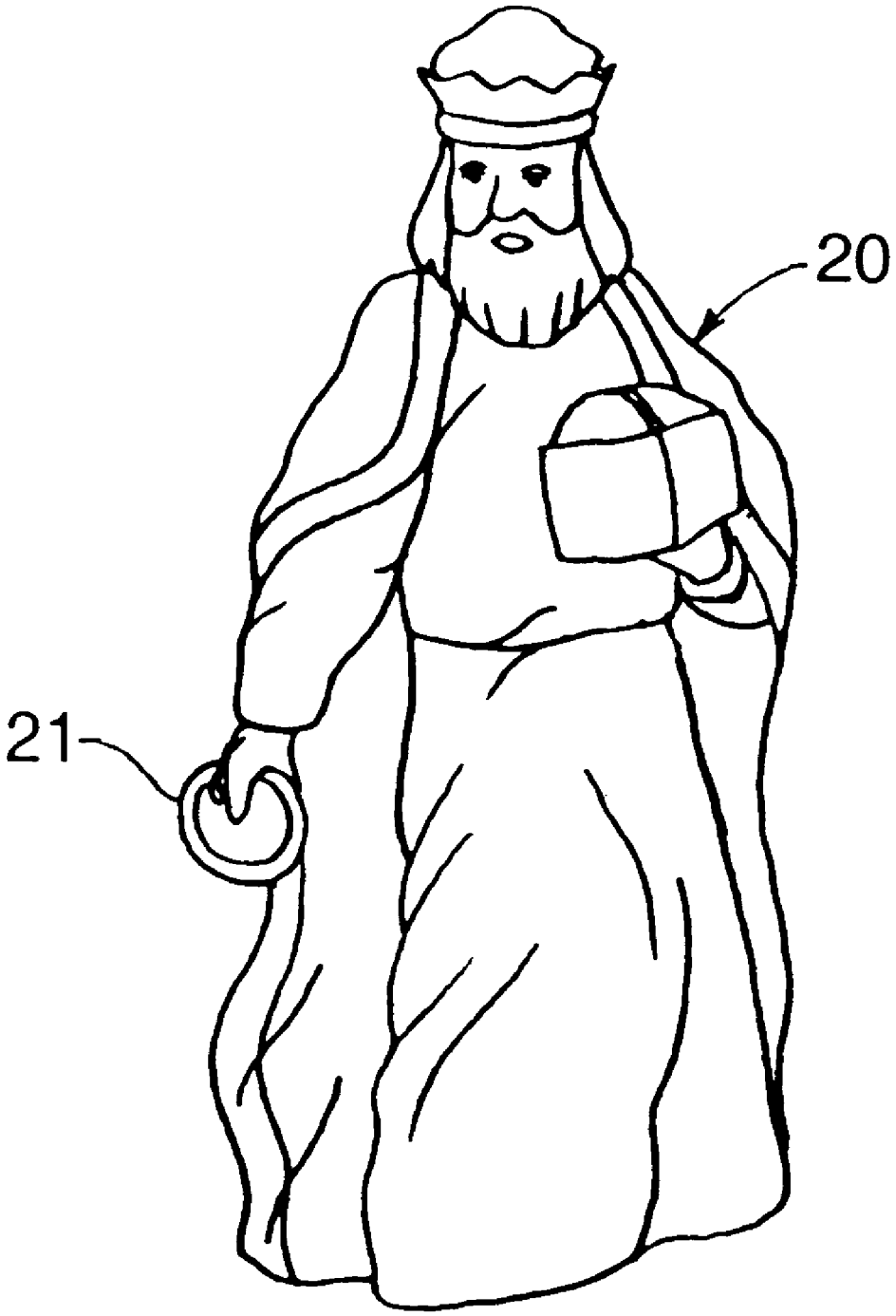
FIG. 2 is a perspective view of a figurine in accordance with the present invention.

An animated display device in accordance with the present invention is shown generally in FIGS. 1 and 2. The display device 10 includes a base 12 covered by a top 14, which includes a display platform 16 depicting a scene. The display platform includes a path or trail 18 over which mobile figurines 20 travel.

The display surface also includes stationary figurines 22 representing people, animals, structures, etc., for recreating a scene. In this example a manger scene is shown. Of course, the display platform and figurines can be formed to create any type of scene.

With reference to FIG. 2, each mobile figurine 20 has a metal base, which cannot be seen in this figure, and preferably a layer of felt (also unshown) covering the bottom surface of the metal base. The metal bases in this embodiment are not magnetized. However, the use of magnetized bases for the figurines is conventional and could optionally be provided. The felt covering helps the figurine to glide smoothly over the trail 18 on the display platform 16.

The figurine includes a ring 21 for the purpose of pulling another figurine along the trail. In this example, a camel FIG. 24 is pulled. It is not necessary for the pulled figurine to include a metal base, but felt covering would be desirable.

The mobile figurines travel along the trail by the force of magnets rotating just beneath the platform surface as will be described in detail below. In one aspect of the invention, the mobile figurines can travel over a non-circular trail which, in FIG. 1, is generally shaped as an oval. In another aspect, the mobile figurines can be made to turn, or twist, at a particular location along the trail. In this example, the figurines generally face forward as they move around the trail, but when they reach the manger they turn to face a stationary baby Jesus figurine as they continue to move. After passing the stationary figurine the mobile figurines turn back to again face forward and continue on their way. These aspects, among others, will be discussed in detail below.

Figure 3:
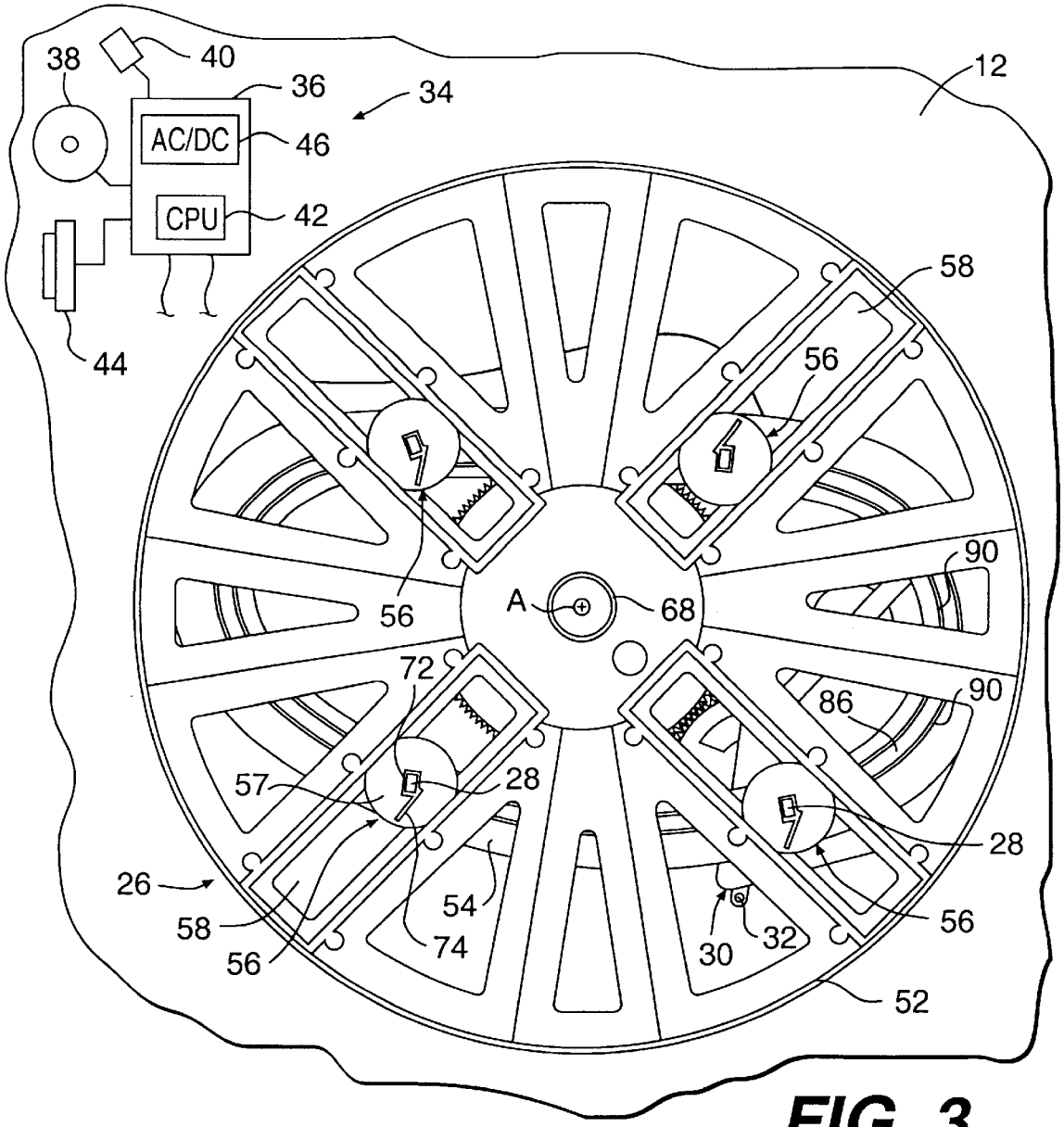
FIG. 3 is a top plan view of the display device, with the platform removed, in accordance with a first embodiment of the present invention.

FIG. 3 is a top view of the display device with the top 14 removed, thus exposing the base 12 and showing a motion assembly 26 for moving a plurality of directional magnets 28 and a drive assembly 30 for rotating the motion assembly about its rotational axis A. The base is ideally formed of a single piece of molded plastic, and provided with a plurality of integrally formed posts 32 for supporting and receiving the top 14 and the motion and drive assemblies by conventional fixing means such as screws.

A controller 34 for operating the display device includes a control board 36, a rotary on/off switch 38 with a volume control and a female adaptor 40 for receiving an electrical cord supplying AC power to the controller. The control board is capable of playing music as the figurines move over the platform, and in that regard includes a CPU 42 with a memory for storing, among other information, a plurality of songs. In addition, a speaker, unseen in this figure, is provided to output the music, and a music change button 44 can be pressed to select a new song.

The control board preferably includes a conventional AC to DC converter circuit 46 for supplying DC current to the CPU to play music, and also to a motor for operating the drive assembly 30. In this regard, a DC motor is best suited for actuating the drive assembly.

As will be appreciated, each of the elements shown in block outline in FIG. 3 is well known, and a specific type of construction is not critical to carrying out the invention or to a disclosure of the best mode for carrying out the invention.

Figure 4:
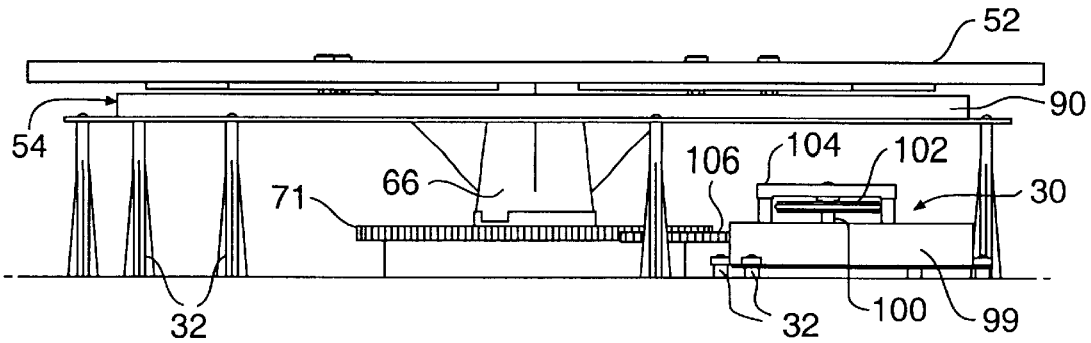
FIG. 4 is a side-elevational view of the display device in accordance with the first embodiment of the present invention, showing a magnet motion assembly and a drive assembly.
Figure 5:
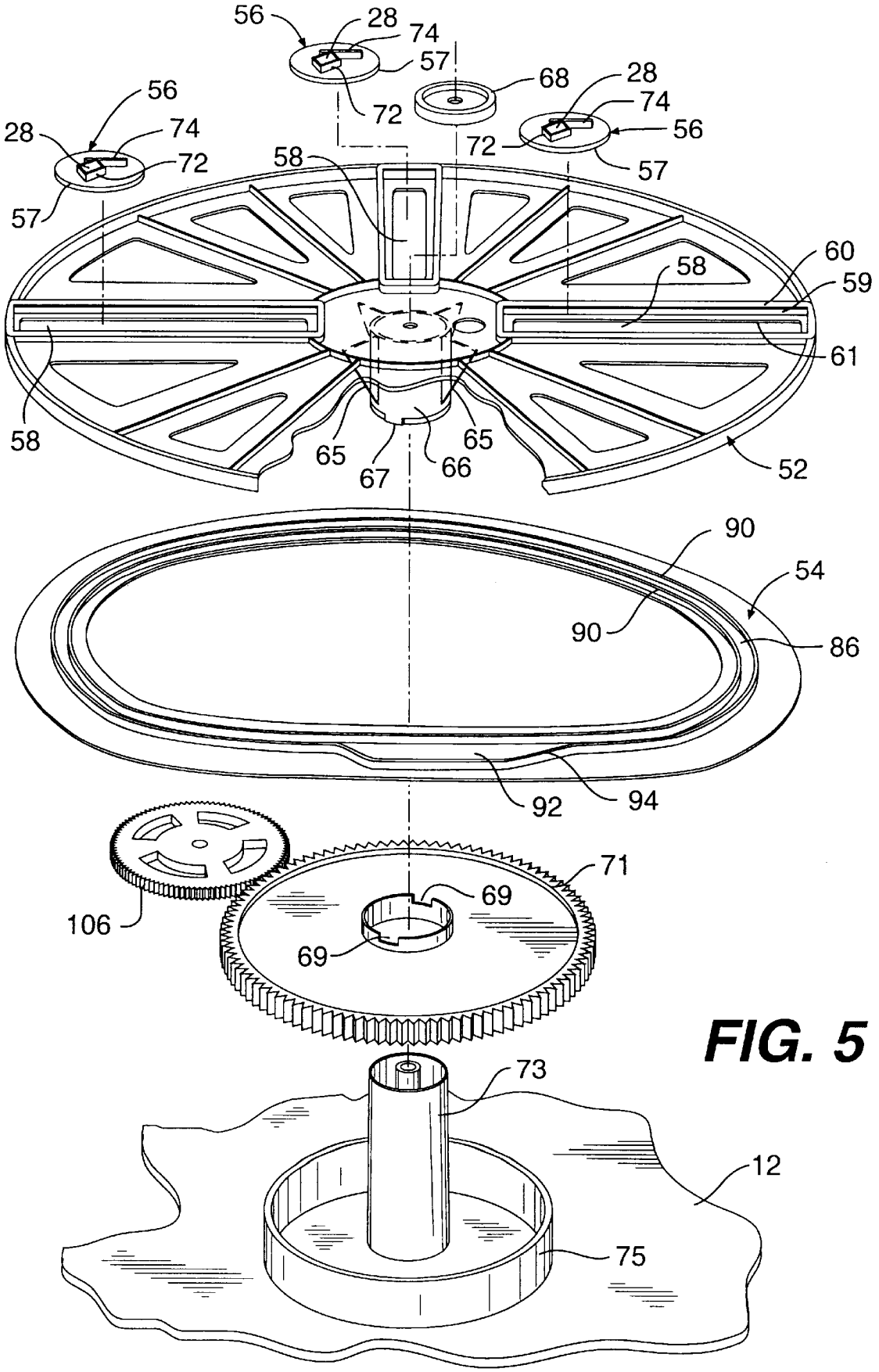
FIG. 5 is an exploded view, in perspective, of the motion assembly and part of the drive assembly in accordance with the first embodiment of the present invention.

As best seen in FIGS. 3 through 5, the main components of the motion assembly 26 in this embodiment are the rotating drive wheel 52 (or magnet drive), the guide track 54 and the magnet holders 56.

The drive wheel 52 is formed, e.g., of a molded plastic, to have a plurality of radial slots 58, in which sit the magnet holders 56. In each slot a magnet holder is confined within a groove 59 formed between a bottom surface 61 of the wheel and a rectangular frame 60.

It will be appreciated that there are alternative ways to secure the magnet holders within the slots, and even alternatives to the drive wheel itself. For example, in a second embodiment shown in FIG. 8 a plurality of rotating arms 62 can be used instead of the wheel. In this figure, an alternative magnet holder 64 sandwiches outer portions 66 of the arm that define the slot 58. In securing the magnet holder, an important consideration is that it be allowed to move radially within the slot and capable of rotating about its own axis. In other words, although the magnet holder is confined within the slot, it is free to slide and rotate.

Returning to FIGS. 3–5, the drive wheel 52 is molded to include a cone 66. As best seen in FIG. 5, the cone 66 itself has structurally supporting fins 65 and a base with teeth 67 (two in this example). The teeth fit into corresponding notches 69 of a drive gear 71.

The drive gear slides over a support post 73 and is rotatably supported on a rim 75 on the base 12. The cone fits over the support post and is secured thereto by an endcap 68. With this arrangement, rotation of the drive gear 71 will rotate the drive wheel about its rotational axis A. Both the support post 73 and rim 75 are preferably formed as integral parts of the base 12.

As best seen in FIGS. 3 and 5, each magnet holder 56 includes a base 57 which sits in the slot 58 and supports a magnet 28 on its top surface. The magnet sits in a support member 72, which includes an extended camming arm 74 that serves to rotate the magnet holder about its rotational axis when actuated by an abutting member as described below.

Figure 8:
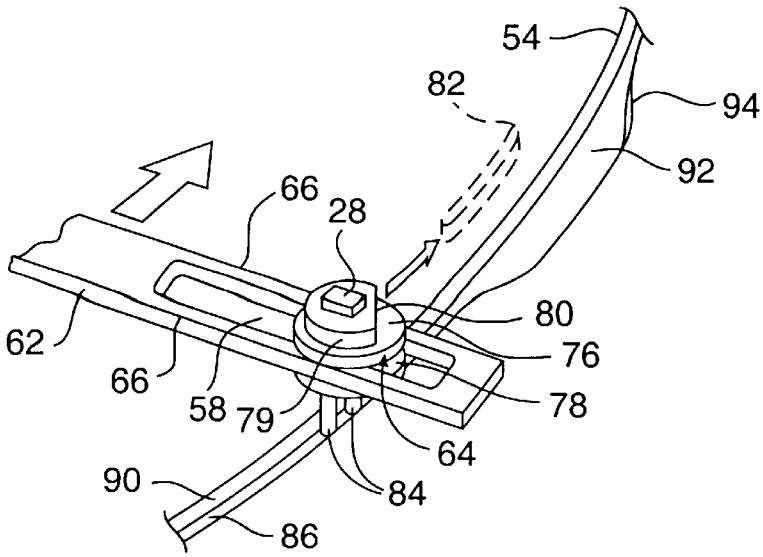
FIG. 8 is a partial perspective view of a motion assembly in accordance with a second embodiment of the present invention.

In the alternative magnet holder shown in FIG. 8, a base 76 includes a circumferential groove 78 for receiving the outer portions 66 of the arm 62. In this embodiment, a camming disc 79 sits on the base 76 and the magnet 28 is secured, e.g., by gluing, on top of the disc. When a cam face 80 of the disc abuts an abutting member 82 as the rotating arm travels in a counterclockwise direction, the magnet holder itself will rotate in a clockwise direction about its own axis.

Figure 6:
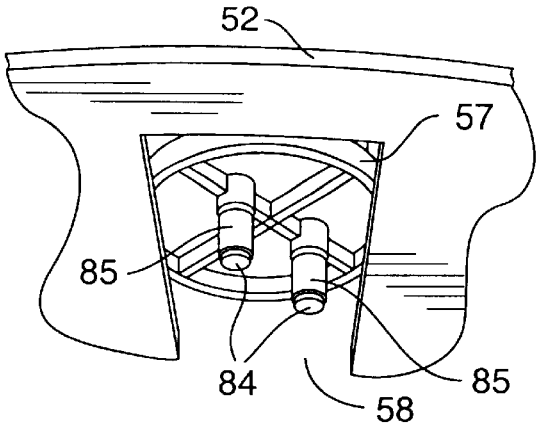
FIG. 6 is a partial perspective view, from below, of the motion assembly in accordance with the first embodiment of the present invention, showing a magnet holder.

Each magnet holder also includes a plurality of pins 84 extending from its bottom surface as best shown in FIG. 6. A rotatable sleeve 85 fits over the pin and is retained by the flat-head type pin. The pins ride in a slot 86 of the guide track as the rotating drive wheel carries the magnet holder. As the pins travel, the sleeves 85 rotate as they contact the vertical side walls of the slot 86. Thus, the magnet holders are transported by the drive wheel along a path determined by the guide track.

As best seen in FIG. 4, the guide track 54 is raised above the base 12 and supported on the posts 32 by conventional means, e.g., screws. The slot 86 in the guide track is defined by vertical walls 90 that can be raised as shown in FIG. 7, as is preferable, or recessed as shown in the second embodiment of FIG. 8.

Figure 7:
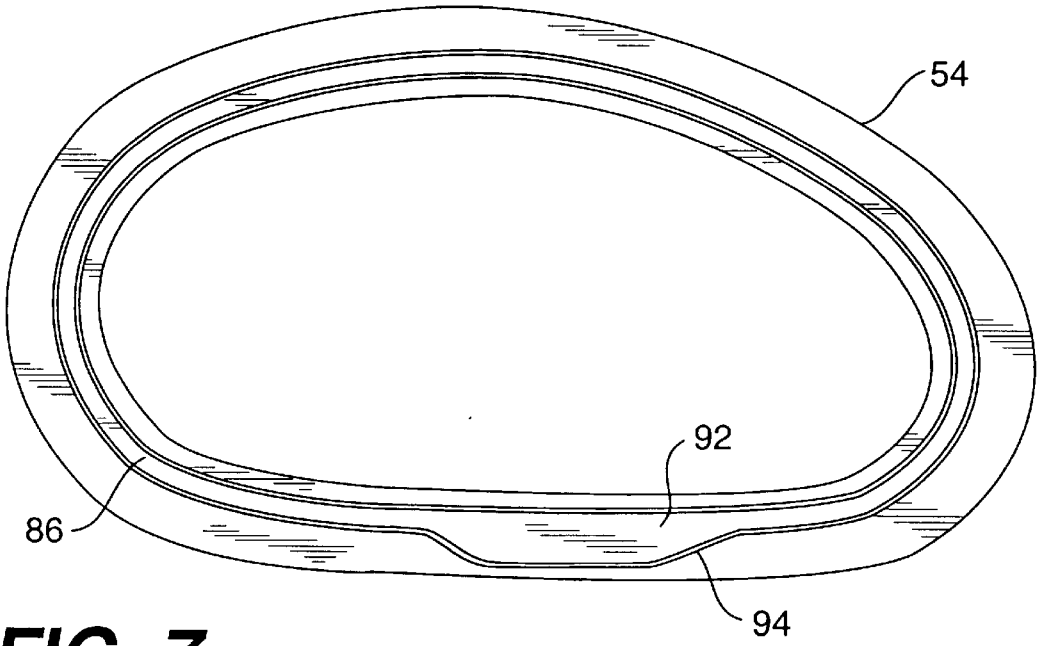
FIG. 7 is a top plan view of a guide track in accordance with the present invention.

As shown in FIG. 7, the shape of the slot 86 in which the magnet holders travel is generally oval. This shape, however, is arbitrary and can be varied to suit the desired path of the mobile figurines. Because of the arrangement of the magnet holders in the rotating drive wheel as described above, and particularly their ability to slide radially with a slot, many different guide track shapes can be used without having to modify the rotating drive wheel.

FIG. 7 also shows that the slot 86 widens at a portion 92. This wide portion allows room for the pins 84 and thus the magnet holder to turn, or pivot. Elsewhere, the slot 86 is only slightly wider than the pins and thus the magnet holder cannot rotate, either accidentally or intentionally.

In both embodiments, and as shown in FIG. 8, the wide portion 92 coincides with an abutting member 82. In this way, as the magnet holder approaches the wide portion 92, the abutting member contacts the camming arm or camming face and causes the magnet holder to rotate in the clockwise direction. This rotation is possible because the wide portion 92 of the slot allows the head pin 84 to move to an outer location of the wide portion (and slightly ahead of the rear pin 84). The wide portion 92 is preferably not so wide that the pins could ride laterally side-by-side, which could allow for the magnet holder to turn too far in the clockwise direction.

The abutting member 82 is ideally located on the underside of the display surface, although alternative ways of supporting the abutting member are within the scope of the invention.

The drive assembly 30 for rotating the drive wheel 52 is best seen in FIG. 4. Within a housing 99 secured to the base is a motor and a gear train (both unshown) for transmitting rotational motion to the drive gear 71, which is keyed to the cone 66 of the drive wheel 52 as described above. Operation of the motor rotates a spindle which, in turn, operates a secondary spindle 100 through an endless belt and pulley arrangement 102. The secondary spindle is supported by a brace 104 and extends into the housing and, through a series of gears, transmits rotary face to the drive gear 71 through auxiliary gear 106. It will be appreciated that the rpm's of the motor spindle is considerably higher than the rpm's of the drive gear 71. Thus, speed reduction is achieved by the gear train within the housing.

As will be appreciated, operation of the motor ultimately rotates the drive gear 71, which in turn rotates the cone 66 and the drive wheel 52. Of course, alternative drive assemblies, such as a series endless belt and pulley arrangements, could be used to rotate the drive gear 71.

In operation, as the drive wheel 52 rotates about its axis (by operation of the drive assembly), the magnet holders are moved along the guide track. With the magnets in the magnet holders being disposed just below the display platform, the mobile figurines are magnetically attracted to the magnets and move over the trail, which is configured to match the guide track. The poles of the magnets are arranged so that the mobile figurines face forward as they travel over the trail.

As the magnet holders move around the rotational axis A of the drive wheel in the counterclockwise direction, they also move radially within the slot 58 in order to follow the non-circular (i.e., varying radius) path of the guide track. As a magnet holder approaches the wide portion 92 of the path 86, the stationary abutting member 82 cams the magnet holder and turns it in the clockwise direction approaching (but not quite) 90°. On the display platform, the mobile figurine follows the turning of the magnet holer and turns to face the outer side of the display. In the animated display shown in FIG. 1, the mobile figurine will turn to face a figurine of baby Jesus in the manger.

As the magnet holder is cammed, the front pin 84 is forced to the outer side of the wide portion 92 of the path 86, as discussed above. As the magnet holder passes the abutting member 82, the sleeve 85 of the inside pin 84 (i.e., the back pin) is in rotatable contact with the inner vertical wall 90 (due to the increasing radial distance from the rotational axis A), while the outside pin is ideally not in contact with the outer vertical wall. This contact creates a drag force which causes the magnet holder to rotate (counterclockwise) back to its original position. An angled wall 94 toward the end of the wide portion will also assist in turning the magnet holder back to its original position is necessary by engaging the outside pin and guiding it back to its original position. The mobile figurine correspondingly rotates back to face forward and continues along the trail.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A driving mechanism for moving a magnetically attracted figurine over a display surface, comprising:

a base;

a guide track below said surface secured to said base;

a magnet driver rotatably mounted to said base;

a driving assembly for rotating said magnet driver; and a magnet holder secured in said magnet driver and riding in said guide track.

2. A driving mechanism according to claim 1, wherein said guide track includes a path with a first portion having a first width and a second portion having a second width wider than the first width.

3. A driving mechanism according to claim 2, further comprising turning means for turning said magnet holder, with said magnet holder positioned in one orientation in the first portion of the path and in a second orientation in the second portion of the path.

4. A driving mechanism according to claim 1, wherein said magnet driver defines a radial slot in which said magnet holder is supported, with said magnet holder capable of sliding radially within the slot to follow said guide track.

5. A driving mechanism according to claim 2, wherein the path of said guide track is non-circular in shape.

6. A driving mechanism according to claim 1, wherein said magnet driver is a rotatable arm and includes a radial slot.

7. A driving mechanism for moving a figurine over a display surface, comprising:

a base;

a guide track secured to said base, wherein said guide track includes a path with a first portion having a first width and a second portion having a second width wider than the first width;

a magnet driver rotatable mounted to said base;

a driving assembly for rotating said magnet driver;

a magnet holder secured in said magnet driver and riding in said guide track; and turning means for turning said magnet holder, with said magnet holder positioned in one orientation in the first portion of the path and in a second orientation in the second portion of the path, wherein said turning means includes a cam on said magnet holder and an abutting member for engaging said cam and turning said magnet holder.

8. A driving mechanism according to claim 7, wherein said turning means further includes a plurality of pins extending from said magnet holder and riding in the path of said guide track, and an angled wall of said guide track.

9. A driving mechanism for moving a figurine over a display surface, comprising:

a base;

a guide track secured to said base;

a magnet driver rotatable mounted to said base, wherein said magnet driver is a rotatable wheel and includes a plurality of radial slots;

a driving assembly for rotating said magnet driver; and a magnet holder secured in said magnet driver and riding in said guide track.

10. A driving mechanism for moving a magnetically attracted figurine over a display surface, comprising:

a base;

a guide track below said surface secured to said base;

a magnet holder riding in said guide track; and a drive assembly for driving said magnet holder in said guide track and about a rotational axis, said drive assembly including a rotating driver securing said magnet holder and allowing for radial movement of said magnet holder as it moves about the rotational axis.

11. A driving mechanism according to claim 10, wherein said guide track includes a path with a first portion having a first width and a second portion having a second width wider than the first width.

12. A driving mechanism according to claim 11, further comprising turning means for turning said magnet holder, with said magnet holder positioned in one orientation in the first portion of the path and in a second orientation in the second portion of the path.

13. A driving mechanism according to claim 10, wherein said rotating driver includes a radial slot in which said magnet holder is supported, with said magnet holder capable of sliding radially within the slot to follow said guide track.

14. A driving mechanism according to claim 11, wherein the path of the guide track is non-circular in shape.

15. A driving mechanism according to claim 10, wherein said rotating driver is a rotatable arm and includes a radial slot.

16. A driving mechanism for moving a figurine over a display surface, comprising:

a base;

a guide track secured to said base, wherein said guide track includes a path with a first portion having a first width and a second portion having a second width wider than the first width;

a magnet holder riding in said guide track;

a drive assembly for driving said magnet holder in said guide track and about a rotational axis, said drive assembly including a rotating driver securing said magnet holder and allowing for radial movement of said magnet holder as it moves about the rotational axis; and turning means for turning said magnet holder, with said magnet holder positioned in one orientation in the first portion of the path and in a second orientation in the second portion of the path, wherein said turning means includes a cam on said magnet holder and an abutting member for engaging said cam and turning said magnet holder.

17. A driving mechanism according to claim 16, wherein said turning means further includes a plurality of pins extending from said magnet holder and riding in the path of said guide track, and an angled wall of said guide track.

18. A driving mechanism for moving a figurine over a display surface, comprising;

a base;

a guide track secured to said base;

a magnet holder riding in said guide track; and a drive assembly for driving said magnet holder in said guide track and about a rotational axis, said drive assembly including a rotating driver securing said magnet holder and allowing for radial movement of said magnet holder as it moves about the rotational axis, wherein said rotating driver is a rotatable wheel and includes a plurality of radial slots.

19. A display device, comprising:

a base;

a guide track disposed on said base;

a magnet driver rotatably supported on said base;

drive means, with at least one driving arm, for rotating said magnet driver about a first rotational axis;

a magnet holder supported in said driving arm for movement in said guide track;

a magnet supported in said magnet;

a display surface above said base, guide track and magnet driver over which a magnetically attracted figurine moves; and turning means for turning said magnet holder about its own axis as it travels in said guide track.

20. A display device according to claim 19, wherein said turning means includes a cam on said magnet holder and an abutting member for engaging said cam and turning said magnet holder.

21. A display device according to claim 20, wherein said guide track includes a path having a first portion with a first width and a second portion with a second width wider than the first width, with said magnet holder positioned in one orientation in the first portion of the path and in a second orientation in the second portion of the path.

22. A display device according to claim 21, wherein said turning means further includes a plurality of pins extending from said magnet holder and riding in the path of said guide track, and an angled wall of said guide track.

23. A display device according to claim 19, wherein said drive means defines a radial slot in which said magnet holder is supported, with said magnet holder capable of sliding radially within the slot to follow said guide track.

24. A display device according to claim 19, wherein said magnet driver is a rotatable arm and includes a radial slot.

25. A display device comprising:

a base;

a guide track disposed on said base;

a magnet driver rotatable supported on said base;

drive means, with at least one driving arm, for rotating said magnet driver about a first rotational axis;

a magnet holder supported in said driving arm for movement in said guide track;

a magnet supported in said magnet holder;

a display surface above said base, guide track and magnet driver over which a magnetically attracted figurine moves; and turning means for turning said magnet holder about its own axis as it travels in said guide track, wherein said magnet driver is a rotatable wheel and includes a plurality of radial slots.

26. A display device comprising:

a base;

a guide track disposed on said base;

a magnet driver rotatably supported on said base;

drive means, with at least one driving arm, for rotating said magnet driver about a first rotational axis;

a magnet holder supported in said driving arm for movement in said guide track;

a magnet supported in said magnet holder;

a display surface above said base, guide track and magnet driver over which a magnetically attracted figurine moves;

turning means for turning said magnet holder about its own axis as it travels in said guide track, wherein said turning means includes a cam on said magnet holder, an abutting member for engaging said cam and turning said magnet holder, a plurality of pins extending from said magnet holder and riding in the path of said guide track, and an angled wall of said guide track, and further comprising a sleeve rotatably disposed on each said pin, wherein said guide track includes a path having a first portion with a first width and a second portion with a second width wider than the first width, with said magnet holder portioned in one orientation in the first portion of the path and in a second orientation in the second portion of the path.

* * * * *

UNITED STATES PATENT AND TRADEMARK OFFICE

CERTIFICATE OF CORRECTION

PATENT NO. : 5,980,356

DATED : November 9, 1999

INVENTOR(S): HUANG MENG-SUEN

It is certified that error appears in the above-identified patent and that said Letters Patent is hereby corrected as shown below:

COLUMN 7:

Line 26, "rotatable" should read --rotatably--.
Line 46, "rotatable" should read --rotatably--.

COLUMN 9:

Line 24, "rotatable" should read --rotatably--.

Signed and Sealed this

Twenty-third Day of January, 2001

*Attest:*

*Attesting Officer*

Q. TODD DICKINSON

*Commissioner of Patents and Trademarks*